US009498699B2

(12) United States Patent
Rancon

(10) Patent No.: US 9,498,699 B2
(45) Date of Patent: Nov. 22, 2016

(54) DEVICE FOR RECEIVING A BOOT ON A GLIDING APPARATUS

(71) Applicant: SALOMON S.A.S., Metz-Tessy (FR)

(72) Inventor: Henri Rancon, Annecy (FR)

(73) Assignee: SALOMON S.A.S., Metz-Tessy (FR)

( * ) Notice: Subject to any disclaimer, the term of this patent is extended or adjusted under 35 U.S.C. 154(b) by 0 days.

(21) Appl. No.: 14/749,922

(22) Filed: Jun. 25, 2015

(65) Prior Publication Data

US 2015/0375088 A1 Dec. 31, 2015

(30) Foreign Application Priority Data

Jun. 27, 2014 (FR) ..... 14 01456

(51) Int. Cl.

| | |
|---|---|
| ***A63C 10/08*** | (2012.01) |
| ***A63C 10/24*** | (2012.01) |
| ***A63C 10/20*** | (2012.01) |
| ***A63C 10/22*** | (2012.01) |
| *A63C 10/04* | (2012.01) |

(52) U.S. Cl.

CPC ..... *A63C 10/08* (2013.01); *A63C 10/20* (2013.01); *A63C 10/22* (2013.01); *A63C 10/24* (2013.01); *A63C 10/04* (2013.01)

(58) Field of Classification Search

CPC ..... A63C 9/08–9/0885; A63C 10/24; A63C 10/26; A63C 10/28

See application file for complete search history.

(56) References Cited

U.S. PATENT DOCUMENTS

| | | | | |
|---|---|---|---|---|
| 6,032,974 | A * | 3/2000 | Saillet | A63C 10/24 267/124 |
| 2004/0119265 | A1 | 6/2004 | Draper et al. | |
| 2004/0169343 | A1 | 9/2004 | Fougere | |

FOREIGN PATENT DOCUMENTS

| | | | |
|---|---|---|---|
| AT | 409 933 | B | 12/2002 |
| EP | 0 804 949 | A1 | 11/1997 |
| WO | WO-03/008049 | A2 | 1/2003 |

* cited by examiner

*Primary Examiner* — Erez Gurari

(74) *Attorney, Agent, or Firm* — Greenblum & Bernstein, P.L.C.

(57) ABSTRACT

The invention relates to a device for receiving a boot on a gliding apparatus, such device comprising a binding base extending along a longitudinal direction from a rear end to a front end, and widthwise from a first side to a second side; a heel loop extending in the direction of the rear end of the receiving device, the heel loop being self-supported by at least one attachment point, the heel loop being connected to the binding base by a connection system comprising at least one point of attachment with the binding base. The connection system between the heel loop and the binding base enables relative spacing or approaching movement between the heel loop and the binding base, and comprises at least one connecting element connecting the rear portion of the heel loop to the binding base and limiting the spacing between the binding base and the rear portion while allowing the approaching movement.

22 Claims, 4 Drawing Sheets

DEVICE FOR RECEIVING A BOOT ON A GLIDING APPARATUS

CROSS-REFERENCE TO RELATED APPLICATION

This application is based upon French Patent Application No. FR 14/01456, filed Jun. 27, 2014, the disclosure of which is hereby incorporated by reference thereto in its entirety, and the priority of which is claimed under 35 U.S.C. §119.

BACKGROUND

1. Field of Invention

The invention relates to the field of equipment for the practice of winter sports, including gliding on snow. The invention relates more particularly to the interface between the user's foot and a gliding board and, to this end, provides a device for receiving a foot or a boot on a gliding apparatus.

Assemblies of this type are intended for snowboarding or snow surfing, for example.

2. Background Information

Known solutions provide receiving devices each adapted to receive a boot of the user. These receiving devices comprise a binding base portion adapted to be fixed in relation to the gliding board. This binding base portion is adapted to receive the sole of the boot. In particular, it is through the binding base that the weight exerted by the user is applied, at least mostly, to the gliding apparatus. The known receiving devices further comprise mechanisms for supporting the boot. They comprise portions ensuring lateral retention of the boot, on the one hand, and at least a fastening of the boot to the binding base, for example by linkages, on the other hand. The assembly thus provides a receptacle capable of adequately maintaining the boot in position in relation to the gliding apparatus and capable of enabling a transmission of the forces applied by the user to control the apparatus, for example during edge setting.

Lateral support is important in this context, and the known techniques use a heel loop adapted to partially surround the bottom portion of the boot beyond the binding base. The heel loop may have a concave shape partially surrounding the heel of the foot or of the boot. The heel loop extends from a lateral side of the binding base to the opposite lateral side, running along the rear portion of the receiving device so as to provide an element of cohesion with the foot, generally at least through the rear of the ankle.

For an efficient transmission of the user's forces to the apparatus, substantial rigidity is currently desired between the binding base and the heel loop. Also, with current designs, the heel loop is not capable of deformation. This rigidity provides good boot support but can be inconvenient for the user during use, especially during lateral or forward movements. Moreover, by being rigid, the heel loop creates hard zones of contact with the boot, more particularly during tilting of the boot about an axis longitudinal to the binding, which can be a source of discomfort. Furthermore, this design limits foot movements in relation to the board. However, for certain practices, especially for performing acrobatic figures, the surfer wishes to have more freedom of movement for greater ease and control of his/her jumps and maneuvers.

Furthermore, this design results in high stresses on the structure of the binding. For example, the fasteners encircling the boot from above the instep are highly stressed. The heel loop is also highly stressed, particularly in bending, during forward movements of the surfer.

Certain bindings provide lateral damping of the heel loop, but with very limited symmetrical clearance. The heel loop still retains too much rigidity.

SUMMARY

The invention provides an improved receiving device.

In particular, the invention provides a receiving device offering more freedom of movement for the foot or boot in relation to the binding base.

The invention also provides a comfortable receiving device.

Further, the invention provides a robust and strong receiving device.

To this end, the invention provides a device for receiving a foot or a boot on a gliding apparatus, such device comprising a binding base extending along a longitudinal direction from a rear end to a front end, and widthwise from a first edge to a second edge; and a heel loop extending in the direction of the rear end of the binding base, the heel loop being connected to the binding base by a connecting system comprising at least one point of attachment with the binding base, the heel loop being self-supported through at least the attachment point.

The connection system of the receiving device includes at least one connecting element connecting a lateral rear portion of the heel loop to the binding base, so as to limit relative spacing movement between the lateral rear portion of the heel loop and the binding base, while allowing relative approaching movement between the lateral rear portion of the heel loop and the binding base.

Due to the invention, a clearance is allowed between the binding base and the rear portion of the heel loop, so that these portions can accommodate variations in stress from the foot or the boot. At the same time, this capability is limited in order not to penalize the support and to preserve the structure of the receiving device.

Limiting the relative spacing movement between the lateral rear portion of the heel loop and the binding base reduces the stresses exerted on the heel loop and more particularly in the area of the attachment points. Indeed, this zone can be highly stressed in bending, which may cause the connection between the heel loop and the binding base to break.

Notable is a better application of the foot or boot on the binding base during movements, in particular forward movements. In addition, the connection between the heel loop and the binding base is less rigid, at least according to an operating phase involving limited clearance, so that it is less stressed and is thus protected from the risk of rupture.

With respect to steering, the connecting elements provide flexibility in the behavior by allowing an energized or non-energized torsion of the foot about a longitudinal axis of the device. Performing stylistic figures is then facilitated.

Furthermore, while the lateral supports of the boot on the heel loop are currently uncomfortable, abutting against the heel loop, they are improved with fewer hard spots in the contact with the heel loop which takes up these forces more broadly and with a certain flexibility. During occurrence of these lateral stresses, the support of the sole on the binding base is preserved.

According to advantageous but non-essential aspects of the invention, such receiving device may incorporate one or more of the following characteristics, taken in any technically feasible combination:

The connecting element is continuously affixed to the binding base or the heel loop, along a spacing direction or an approaching direction.

The connecting element is affixed to the binding base and the heel loop, along a spacing direction, when the rear lateral portion of the heel loop and the binding base are spaced apart by a predetermined distance.

The connecting element is an elongated element comprising a first end, designed to be affixed to the heel loop, and a second end designed to be affixed to the binding base.

The connecting element is a supporting leg, lug, cable, strap, or wire.

One end of the connecting element is designed to move slidably in relation to the binding base or the heel loop, during relative approaching movement between the rear lateral portion of the heel loop and the binding base. According to one embodiment, this end of the connecting element comprises a stop element capable of cooperating with an abutment surface of the binding base or of the heel loop so as to block the relative spacing between the rear lateral portion of the heel loop and the binding base.

The connecting element is rotatably mounted on a shaft fixed to the heel loop, such shaft being configured to further connect the heel loop to a boot instep holding linkage.

The receiving device comprises a rear support element hinged around the shaft or in relation to the binding base.

The connecting element is deformable during relative approaching movement between the rear lateral portion of the heel loop and the binding base.

A compressible element connecting the binding base and the heel loop and configured to exert a force tending to oppose the approaching movement between the binding base and the heel loop by compressible deformation.

The binding base and the heel loop form a single monolithic element.

The connecting member is dimensioned so as to obtain an asymmetrical deformation stroke of the heel loop, the median point of the heel loop being capable of moving closer to the binding base than moving away therefrom.

Another aspect of the invention relates to a gliding apparatus comprising at least one receiving device as described above.

BRIEF DESCRIPTION OF DRAWINGS

The purposes, objects, as well as the characteristics and advantages of the invention will become more apparent from the following detailed description of an embodiment of the invention, illustrated by the following annexed drawings, in which:

FIG. 3 is a side view of

DETAILED DESCRIPTION

Figure 1:
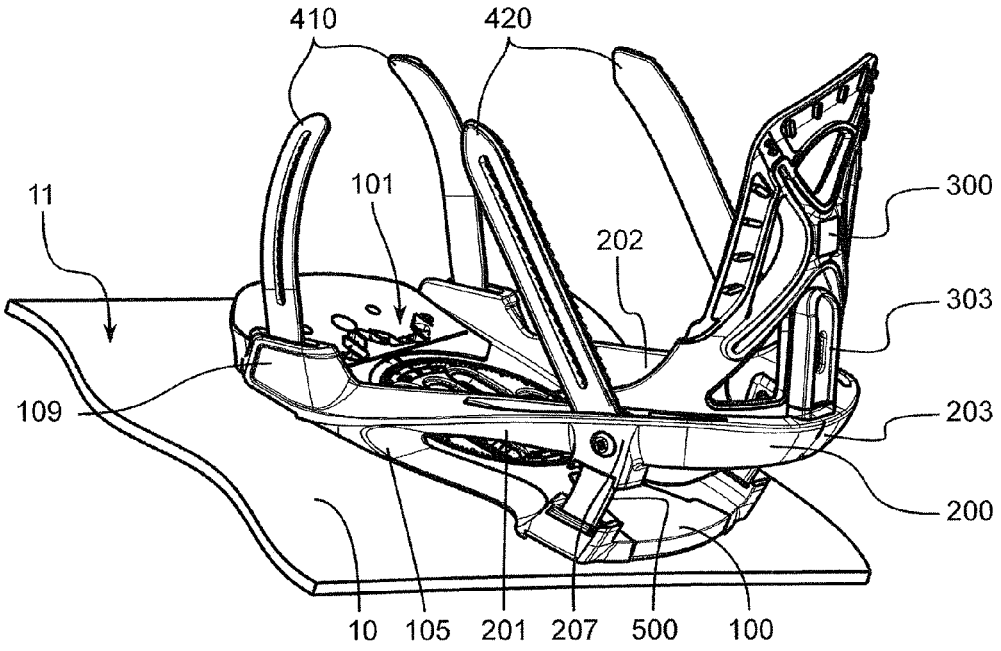
FIG. 1 is a rear perspective view of an embodiment of the invention.

The drawings are given as examples and are not limiting to the invention. They are schematic illustrations intended to facilitate the understanding of the invention and are not necessarily to scale for practical applications.

Before details of various embodiments of the invention are described, particularly with reference to the various drawing figures, some specifics are provided below.

In general, by longitudinal direction of the receiving device is meant the direction corresponding to the length of the foot or boot of the user and oriented along the direction referenced by the character "x". When the receiving device is mounted on a gliding apparatus, this direction "x" is generally directed obliquely in relation to the longitudinal direction of the gliding device, in particular a surfboard. Unless otherwise provided, the term width means a direction perpendicular to the longitudinal direction and corresponding to a width dimension of the foot or boot of the user. This direction is illustrated by the reference character "y". Finally, the terms "height" and "vertical direction" designate a dimension directed along the height of the user positioned at rest and correspond to the direction referenced by the character "z".

According to this description, a first element is considered to be "affixed" to another element when the two elements are connected for at least one degree of freedom, it being understood that the elements may not be connected for other degrees of freedom. For example, an element may have freedom of rotational movement along an axis in relation to another element and may be connected translationally along another direction. Similarly, an element is fixed in one direction when its mobility is prohibited in relation to another element in that direction. This does not necessarily imply that the element is also fixed in other directions, whether in translation or in rotation. Thus, the term "fixed" along a direction does not necessarily imply a complete embedment of two elements.

Generally, the front portion of the device relates to a portion directed more towards the distal end of the boot or foot of the user, that is to say, towards the toes. Conversely, the term "rear" relates to portions directed towards the rear end of the foot or the boot, in the area of the heel. The adjective "median" relates to a zone located in the middle of the dimension along the longitudinal direction of an element.

Figure 3:
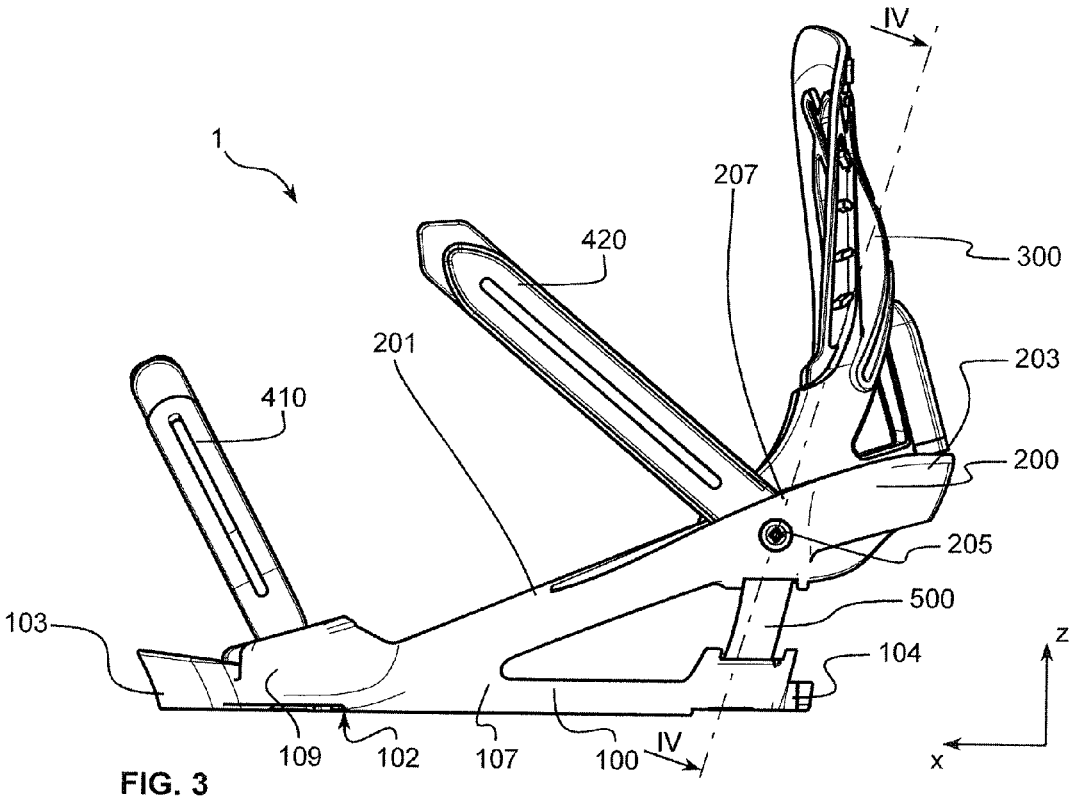
Figure 4:
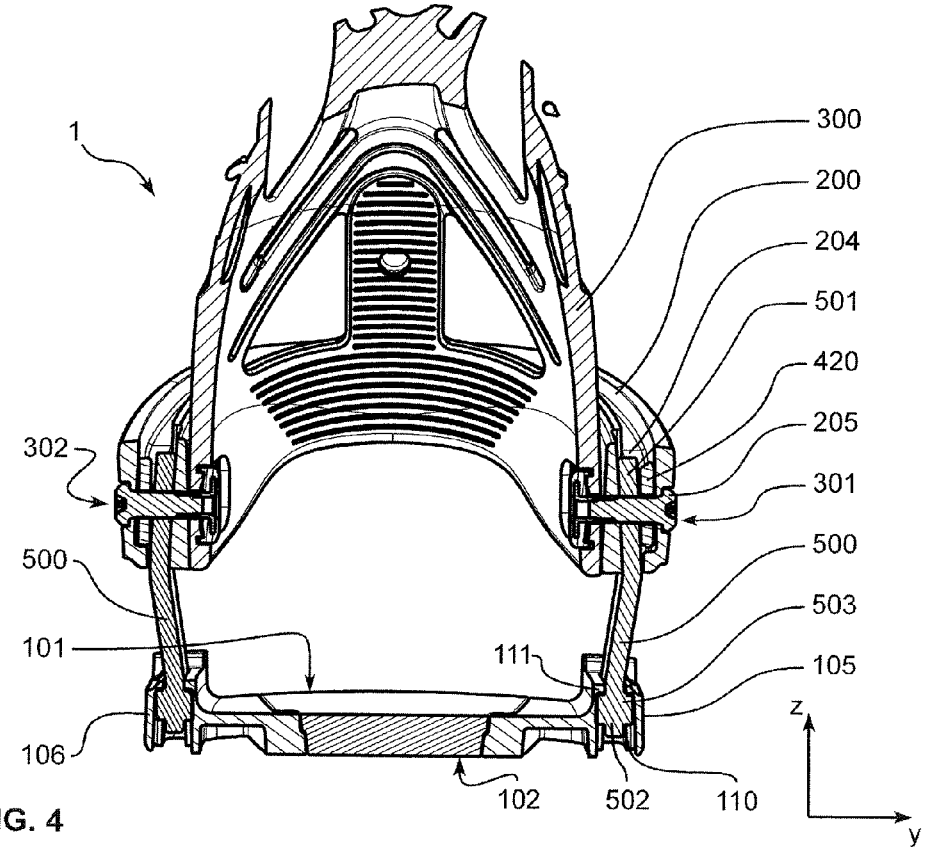
FIG. 4 is a cross-sectional view along the line IV-IV of FIG. 3.

FIG. 1 generally shows an embodiment of the receiving device 1 of the invention to be attached to a gliding board 10. More specifically, the receiving device 1 comprises a binding base 100, an upper surface 101 of which is designed to cooperate with the foot or boot of the user through the sole. Opposite the upper surface 101, a lower surface 102 is designed to come into contact with an upper surface 11 of the gliding board 10. More specifically, the binding base 100 generally comprises a front end 103 and a rear end 104 referenced in FIGS. 3 and 5, for example. The ends 103, 104 are joined, substantially along the longitudinal direction "x". The binding base is demarcated laterally by a first side 105 and a second side 106. Known expedients can be provided to fix the binding base 100 to the gliding board 10.

In addition to this portion for support through the bottom portion of the boot, the receiving device 1 comprises various elements for retaining the foot or boot within the device. In particular, a heel loop 200 is formed so as to extend laterally in relation to the binding base 100 and towards the rear portion of the binding base and, therefore, of the device. The heel loop is designed so as to surround the heel and the lateral sides (lateral and medial) of the boot.

In the area of the first 105 and second 106 sides, the heel loop 200 is attached to the binding base 100 via first 107 and second 108 attachment points. In the example shown in the various drawing figures, the first attachment point 107 corresponds to the triangulated assembly between a lateral portion 201 of the heel loop 200 and a lateral portion 105 of the binding base 100.

In the embodiments shown in the drawing figures, the attachment points 107, 108 are formed in the area of the front portion of the binding base 100, that is to say, forward of its median zone, towards the front end 103. The first 107 and second 108 attachment points participate in a connection system between the binding base 100 and the heel loop 200, providing rigidity which ensures retention and mechanical coherence between these two portions. In this example, the binding base 100 and the heel loop 200, connected in the area of the attachment points 107, 108, form a single monolithic element. Alternatively, the heel loop may be separate from the binding base. In this case, the heel loop is attached to the binding base by appropriate attachment expedient. According to an alternative, the heel loop forms a closed loop, shaped to follow the shape/morphology of the boot. In this case, the heel loop may be fixed to the binding base at a single point, for example on a central area of the binding base. Consequently, the receiving device includes a single attachment point. Conversely, the heel loop may include more than two points of attachment to the front portion of the binding base. Thus, the invention covers a multitude of solutions to make the heel loop. Each arch comprises two lateral arms extending towards the rear of the device and connected by a curved portion in its rear portion.

The invention provides a capability of relative movements of the rear portion of the heel loop 200 and of the binding base 100. The connection system is therefore configured to allow this relative clearance. In this example, the heel loop 200 extends rearward and is included in a plane inclined in relation to the plane of the binding base, by an angle between 15° and 45°. This inclination makes it possible to increase the length of the lateral portions 201 of the heel loop, thereby enabling them to bend more easily about an axis substantially connecting the attachment points 107, 108. In other words, this bending deformation can be likened to a rotation about an axis directed along the dimension "y" of the device and centered on the center of the first 107 and second 108 attachment points, yet deformation being necessary for movement of the heel loop, rather than pivoting about a pivot connection, such as about a journal element of the prior art, during use of the device. The clearance results in a relative spacing or approaching movement between the rear portion of the heel loop and the binding base. This relative movement is substantially vertical.

Forms of connection other than those illustrated are within the scope of the invention. Furthermore, the particular illustrated first 107 and second 108 attachment points are not limiting, and the connection system may comprise additional connections, or the attachment points 107, 108 can be made in a plurality of portions.

Before details of the cooperation between the heel loop 200 and binding base 100 are described in detail, the receiving device 1, in the illustrated examples, comprises front linkages 410, or strap portions, attached in the area of the binding base 100 by means of fastening zones 109 and enabling the positioning of an element for holding the forefoot of the boot in the area of the toe.

Similarly, rear linkages 420, or strap portions, are attached in the area of the binding base, enabling the positioning of a boot instep holding element.

The linkages 410 and 420 are complementary in retaining the boot of the user in position in the area of two distinct zones along the longitudinal dimension of the receiving device 1.

Figure 2:
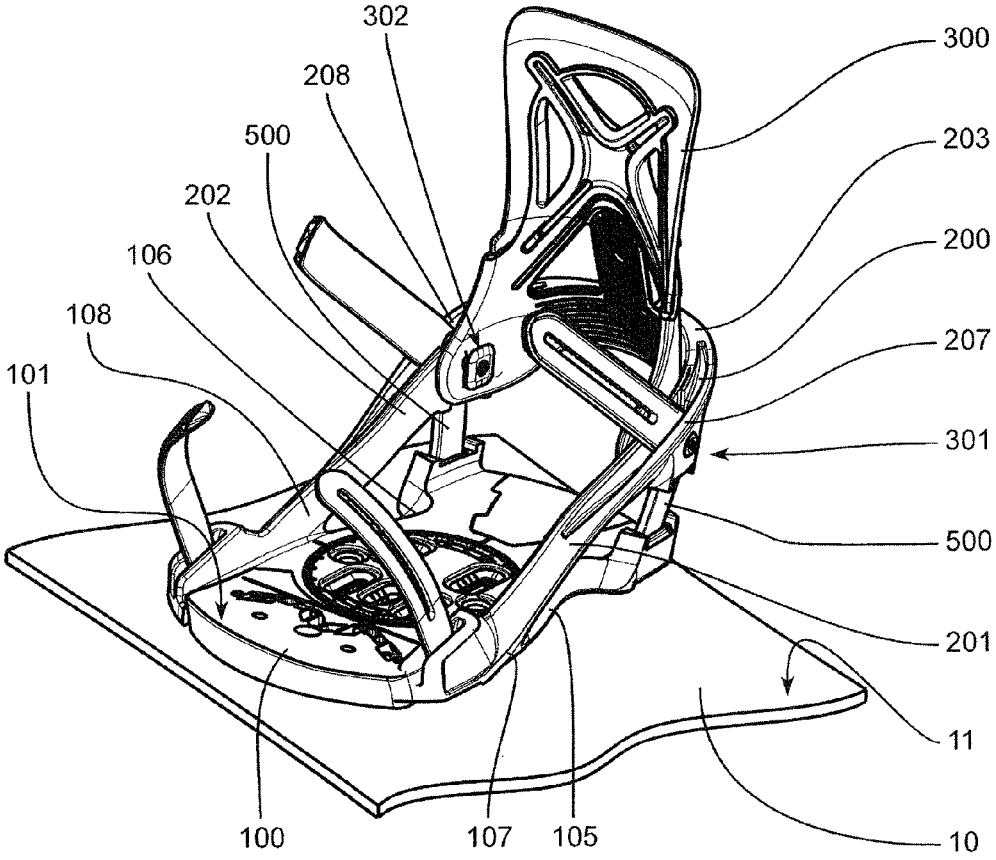
FIG. 2 is a front perspective view of this embodiment.

In the example illustrated, another element for retaining the boot in position is constituted by a rear support element 300 extending along the height dimension of the receiving device 1 so as to extend in the heel loop 200 in this direction and to serve as an additional support element for the rear of the boot on the receiving device 1. The rear support element 300 substantially has the shape of a housing or shell capable of assuming the shape of the rear of the boot. The rear support element 300 is articulated in relation to the heel loop 200 via first 301 and second 302 articulation zones shown schematically in FIGS. 1 and 2.

To limit the rearward tilting of the rear support element 300 in relation to the binding base 100, the element 300 is supported on the heel loop 200. According to the illustrated embodiment, the rear support element 300 is provided with a stop 303 designed to press on a portion of the heel loop 200, in a maximum rearward pivot position.

In an alternative embodiment, the rear support element 300 can be pivotally mounted in relation to the binding base 100 and not in relation to the heel loop 200.

As indicated above, the connection system positioned between the binding base 100 and the heel loop 200 enables a residual freedom of movement, and in particular a relative movement enabling the rear portion of the heel loop 200 to be moved either closer to the binding base 100, or away therefrom along the same direction of movement which, due to the low angles implemented, corresponds to a clearance on an angular sector substantially comparable to a vertical translation between the rear portion of the heel loop 200 and the rear portion of the binding base 100.

According to the invention, the relative spacing or approaching movement is limited in its stroke so as not to allow the rear portion of the heel loop 200 to be overly spaced in relation to the binding base 100.

Thus, during movements, the user benefits from a phase whereby the heel loop 200 substantially follows these lateral or forward movements, and from a phase during which the rear portion of the heel loop 200 is no longer capable of being spaced from the binding base 100 so as to avoid excessive spacing likely to penalize the retention of the boot and so as to avoid an excessive bias of the attachment points 107, 108 between the binding base 100 and the heel loop 200.

To achieve a connection system limiting the stroke of the relative movement between the binding base 100 and the heel loop 200, the invention implements connecting elements 500, two embodiments of which are illustrated in the drawing figures.

Thus, the connection system, in the area of at least one side 105, 106, comprises a connecting element 500 connecting a rear lateral portion 207, 208 of the heel loop to the binding base so as to limit relative spacing movement between the rear lateral portion of the heel loop and the binding base, while allowing relative approaching movement between the rear lateral portion of the heel loop and the binding base.

Figure 5:
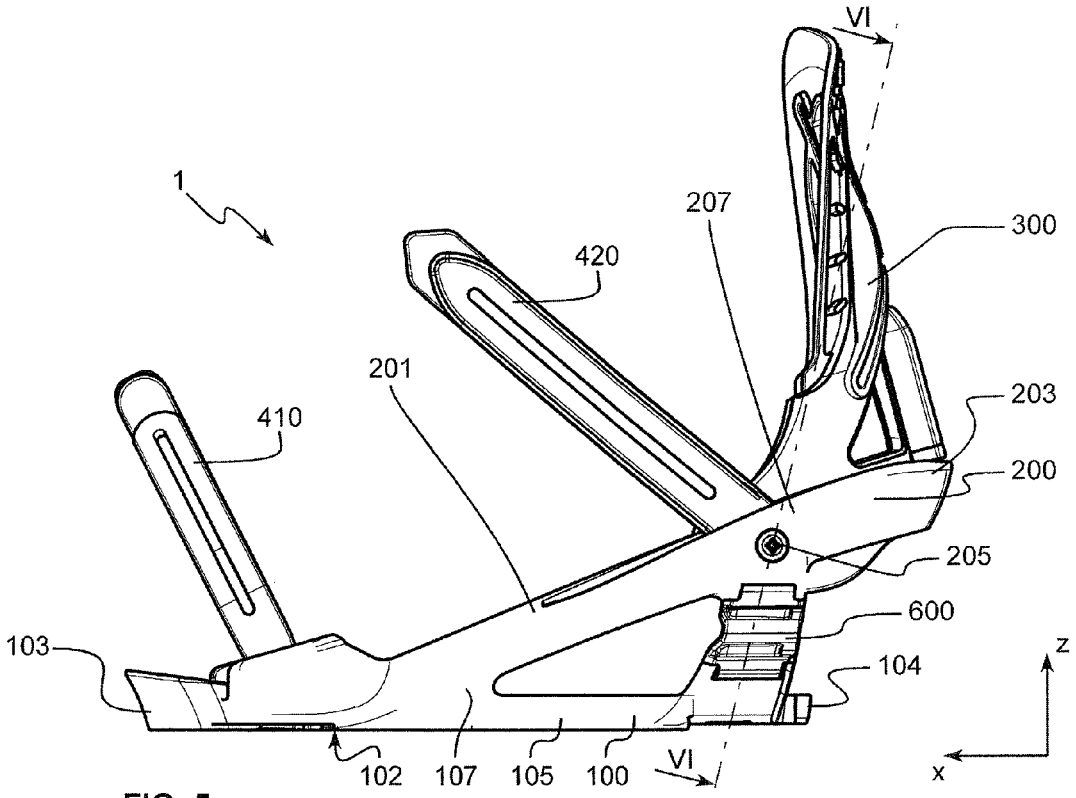
FIG. 5 is a side view of a second embodiment.
Figure 6:
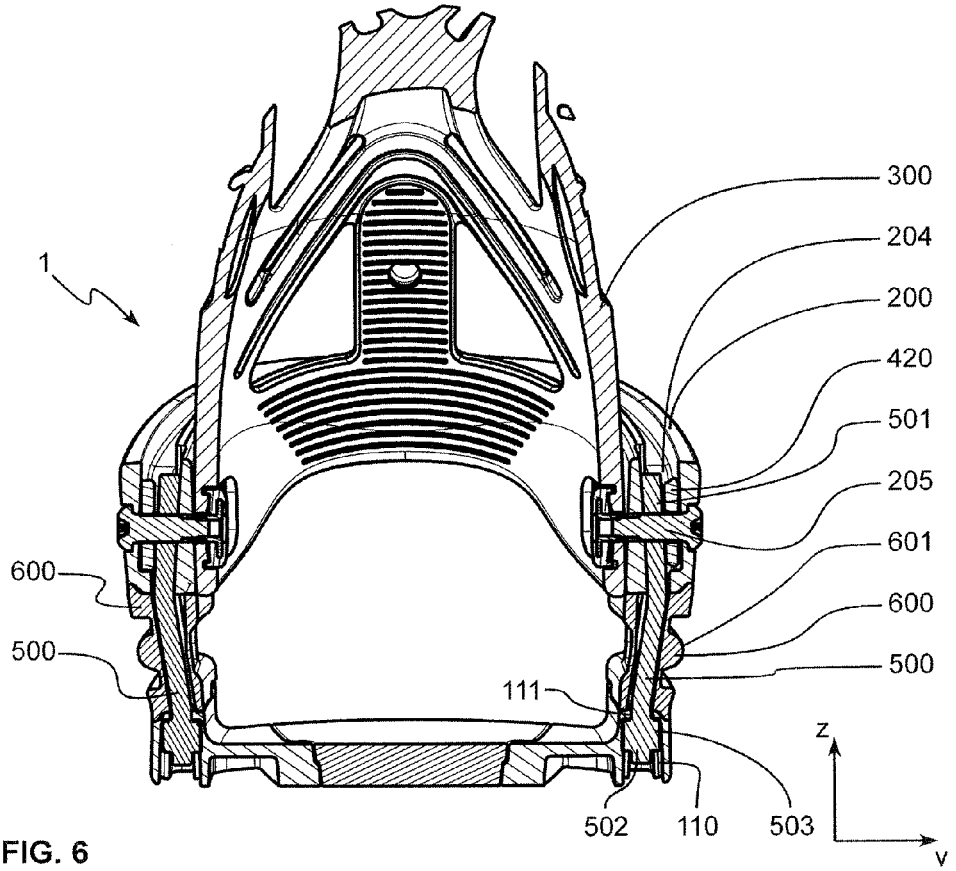
FIG. 6 is a cross-sectional view along the line VI-VI of FIG. 5.
Figure 7:
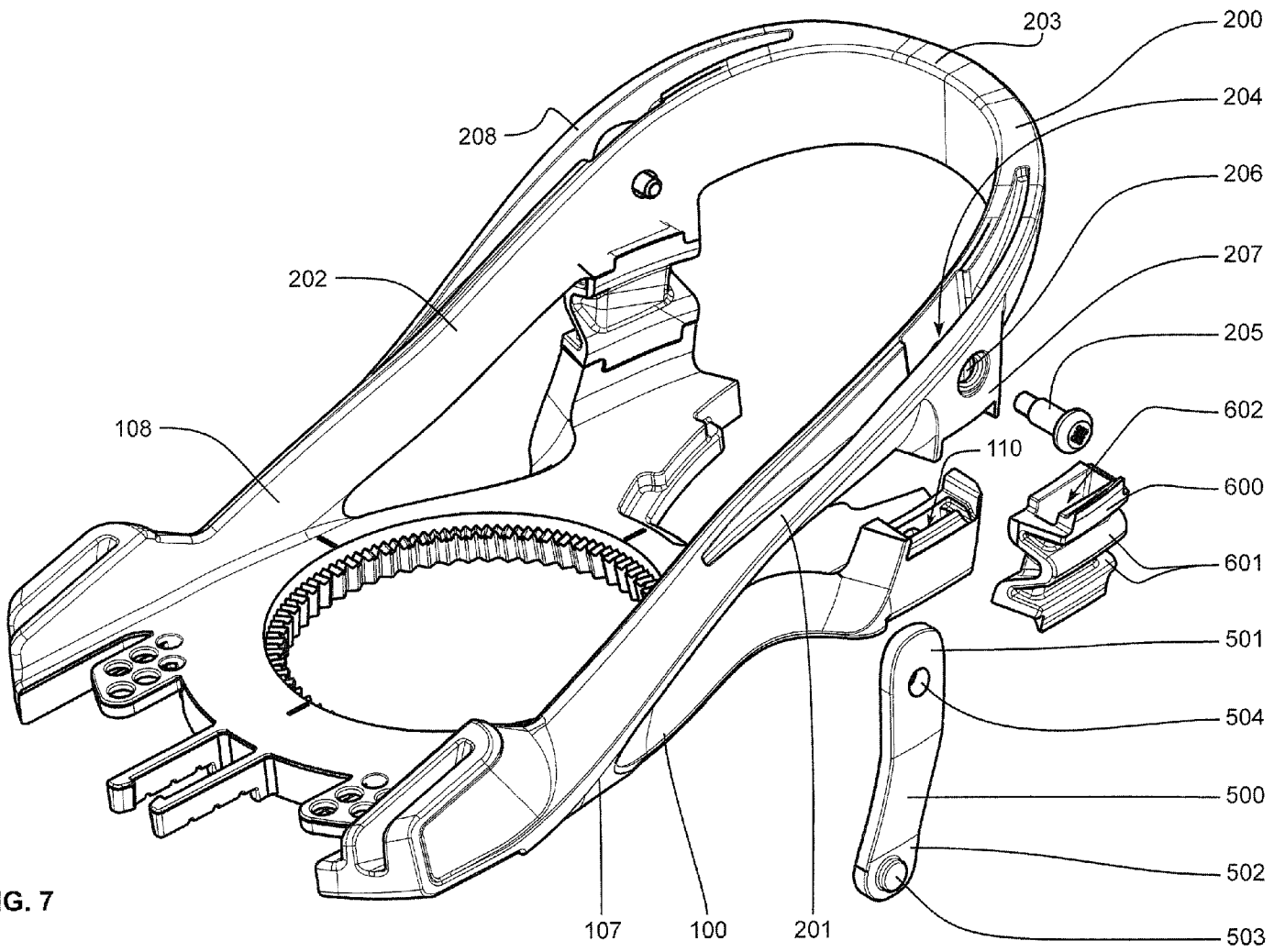
FIG. 7 is an exploded view of certain components of the receiving device of the second embodiment.

In the case of FIGS. 1 to 4, the connecting member 500 arranged on each side of the binding base 100 is a separate element. In the embodiment of FIGS. 5 to 7, the connecting element 500 is coupled to a compressible element 600.

With reference to the first embodiment of FIGS. 1 to 4, two connecting elements 500 are shown, each located on a different side 105, 106 of the binding base 100. More particularly, the connecting elements 500 may be located in the rear portion of the first 105 and second 106 sides of the binding base 100. In this way, each connecting element 500 also cooperates with a rear lateral portion 207, 208 of the heel loop 200.

In general, the connecting element 500 is configured to allow, along a limited range of clearance, the displacement of the rear portion of the heel loop 200 in relation to the binding base 100, through a change in the configuration of the elements 500. This change in configuration means a deformation of the connecting element 500, a movement of the element 500, or any other change in shape or position of the element 500 making it possible to limit the clearance. The change in configuration of the connecting element 500 allowing the clearance is however limited, such that only a relative mobility stroke between the heel loop 200 and the binding base 100 is possible.

In the embodiment of FIGS. 1 to 4, the element 500 is in the form of a leg, that is, a connecting or support link. For example, the link 500 can be an elongated element made of a polymeric material, in particular polyurethane or polycarbonate, such leg being mounted on the heel loop 200, on the one hand, and on the binding base 100, on the other hand. The connecting links cooperate with the binding base 100 and the heel loop 200 through zones in which the connections operate.

These connections are not synonymous of embedment in the context of the invention, in the sense that kinematic freedoms may be preserved therein, as indicated below. More specifically, in this example, each of the legs forming a connecting element 500 is affixed to a rear lateral portion 207, 208 of the heel loop 200 so as to connect its displacement in the direction of the desired relative movement between the binding base 100 and the heel loop 200, namely the spacing away or the approaching movement.

In the illustrated embodiment, this positional fixing is carried out through a shaft 205 extending through a hole 504 located at a first end 501 of the connecting member 500, or leg, and cooperating with a bearing made in the heel loop 200. Thus, the displacement of the rear portion of the heel loop 200 causes the same displacement of the leg 500 given that the leg is not biased. However, with this construction, the leg may also rotate about the shaft 205. The connecting element is therefore rotatably mounted on the heel loop. This makes it possible to exert less stress on the connecting element during deformation of the heel loop.

This configuration is particularly visible with reference to the second embodiment and in particular with reference to FIG. 7, the mounting of the connecting element 500 being similar between the two embodiments illustrated. Also shown in FIG. 7 is that the heel loop 200, in this embodiment, has a slot 204 in the area of each of the lateral portions 201, 202, such slot being substantially oriented along the height direction corresponding to the direction "z". The slot 204 extends through the heel loop 200 in the area of the hole 206 forming the bearing of the shaft 205, so that the first end 501 of the connecting element 500 can be inserted inside the heel loop 200 to be held therein by the shaft 205. The latter may be in the form of a screw, for example, the head of which blocks one side of the heel loop 200 and cooperates with an opposite fastening element, performing the function of a nut.

In a particular embodiment, the vertical slot 204 of each lateral portion 201, 202 of the heel loop 200 has surfaces along its height for laterally guiding the connecting element 500. It is to be generally understood that the fixing of the connecting element 500 is intended to enable a transmission of force along the direction of the desired relative movement. Conversely, in the embodiments of FIGS. 1 to 7, the connecting element 500 has mobility capability in relation to the binding base 100. More particularly, in the examples, the leg forming the connecting element 500 and having a substantially elongated shape along the direction "z", has a second end 502 designed to be inserted into a housing 110 made within a side 105 or 106 of the binding base 100, in which the second end 502 has mobility capability, along the direction of relative movement between the heel loop 200 and the binding base 100. An exemplary housing 110 is shown in the exploded view of FIG. 7, in which the housing 110 is directed along the height of the receiving device 1 and comprises an upper opening positioned opposite the slot 204. This upper opening is provided to allow the connecting element 500 to extend therethrough. In this example, the housing 110 extends through the binding base 100 and forms a slot.

The housing 110 is dimensioned to guide the connecting element 500, and more particularly its second end 502, during displacement of the connecting element resulting from the deformation of the heel loop. The second end 502 can then slide along a guiding direction substantially vertical in this example. Consequently, the connecting element is designed to slidably move in relation to the binding base, during relative spacing or approaching movement between the rear lateral portion of the heel loop and the binding base.

In the situation shown, the connecting element 500 is assembled to the receiving device 1 assembly due to a lower opening of the housing 110 opening out on the lower surface 102 of the binding base. This lower opening is opposite the upper opening facing the heel loop 200. Thus, the element 500 may be fitted into the housing 110, on the side of the lower surface of the binding base, so as to extend through the housing 110. The element 500 is then positioned so that its first end 501 is inserted into the slot 204 of the heel loop 200. The first end 501 is then fixed to the heel loop by the shaft 205. In these cases, it is therefore between the binding base 100 and the connecting member 500 that the freedom of relative movement between the binding base 100 and the rear portion of the heel loop 200 occurs.

At the same time, this freedom of movement is limited so as to avoid excessive relative spacing between the two elements. To this end, the connecting element 500 has a stop element 503, an exemplary embodiment of which is illustrated in perspective in FIG. 7 and in cross section in the two embodiments illustrated in FIGS. 4 and 6. By way of example, the stop element 503 may be in the form of a projection projecting on one or both sides of the second end 502 of the leg forming the connecting element 500. A projection with a circular cross section forming a pin on the surface of the leg may be suitable. The stop element 503 cooperates with an abutment surface 111 provided on the binding base 100 and, in particular, in the illustrated embodiments, the housing 110 of the binding base 100.

In these examples, the housing 110 defines an inner volume for the clearance of the second end 502 of the connecting element 500 but comprises, in the area of its opening opposite the heel loop 200, a cross section narrowing, the opening width of which slightly greater than the average thickness of the leg but less than the width in the area of the stop element 503. Thus, the cross section narrowing allows passage of most of the connecting element 500, with the exception of the stop element 503 which corresponds to a greater width. Thus, the second end 502 of the connecting element 500 can move downward but is blocked in upward translation due to the abutment surface 111 against which the stop element 503 abuts. Downward, once the receiving device 1 is mounted on the gliding board, the upper surface 11 of the gliding apparatus defines an abutment surface for the leg, so that the clearance of the second end 502 of the connecting element 500 is also limited in this direction.

Thus, the first end 501 of the connecting element 500 is designed to be affixed to the heel loop 200, while its second end 502 is designed to be affixed to the binding base 100.

According to one embodiment, each side 105, 106 of the binding base 100 is equipped with a connecting element 500. For example, the connecting elements 500 are symmetrically arranged along the longitudinal direction of the receiving device 1, i.e., the direction "x". In this way, they achieve a movable connection allowing not only a spacing or approaching movement only by rotation about the axis "y"; but they can also perform a torsional movement whereby a connecting element 500 located on a side 105 or 106 is mobilized in the approaching direction, while the other connecting element 500 located on the other side 106 or 105 is mobilized away or is held in position.

The illustrated embodiment shows a connecting element 500 that is fixed in relation to the heel loop 200 and movable in relation to the binding base 100. This configuration can be reversed within the scope of the invention by fixing the connecting element 500 in relation to the binding base 100 and by allowing a relative freedom of movement between the first end 501 of the element 500 and the heel loop 200.

Furthermore, it is also possible for both ends 501, 502 of the connecting element 500 to have a limited relative freedom of movement with respect to the heel loop 200 and binding base 100, respectively. For example, the housing design used for the housing 110, described for the binding base 100, can be reproduced in the area of the heel loop 200 so as to provide a corresponding freedom of movement therein.

In the examples described, each connecting element 500 passes through a slot 204 of the heel loop and through a housing 110 of the binding base also corresponding to a slot. This construction is not limiting. For example, a connecting element 500 may be in a laterally open housing, thereby facilitating its positioning. It may be a plate comprising an oblong hole in which a pin is housed.

In a non-illustrated case, the limited clearance offered by the connecting element 500 is not provided by a relative displacement of the connecting element 500 and of the binding base 100 or the heel loop 200, but by a deformation of the connecting element 500.

In a first embodiment, this deformation means a change in the shape of the connecting element 500, in particular by bending or buckling following a compression along the direction of the relative movement of the heel loop 200 toward the binding base 100. To this end, the connecting element 500 is dimensioned so as to allow this bending or buckling deformation. For example, the connecting element may be a substantially elongated and thin leg made of material capable of such deformation. In another case, the connecting element 500 is elastically deformable, in particular in compression during movement toward the binding base 100. Thus, in this case, the connecting element 500 may be a block of elastomeric material or rubber, a spring, in particular a compressible helical spring, or a block of foam. In this case, the ends 501, 502 of the connecting element 500 may each be fixed or affixed to the heel loop 200 and the binding base 100, respectively. Advantageously, the connecting element 500 undergoes little or no extensional deformation. This makes it possible to provide rigidity in the tension connection and thus to limit the spacing of the rear portion of the heel loop in relation to the binding base.

FIGS. 5 to 7 show a variation of the invention with respect to the embodiment of FIGS. 1 to 4. The overall configuration of the receiving device 1 is similar to that described above. Thus, the connecting elements 500 are in a form equivalent to that of FIGS. 1 to 4. However, in these drawing figures, the connecting element 500 fitted on each side of the binding base 100 is coupled to a compressible element 600. The compressible element 600 is intended to provide damping the relative approaching movement between the heel loop 200 and the binding base 100. To this end, the rigidity of the compressible element 600 is selected to be less than that of the leg 500. For example, the compressible element 600 selected may be made of a flexible polyurethane, rubber, elastomer, or may be in the form of a spring or a polymer foam.

To take up force satisfactorily during relative spacing between the heel loop and the binding base, the leg 500 is characterized by a Young's modulus between 500 MPa and 3000 MPa in torsion. The compressible element 600 acts as a stop when the heel loop and the binding base move toward one another. It is characterized by a Young's modulus of less than 1000 MPa. Play may be provided between the compressible element and the heel loop so as to increase the clearance stroke when the heel loop and the binding base move toward one another. The compressible element 600 may further have a hardness of 50-70 Shore A or, in a particular embodiment, 60 Shore A.

In the embodiment shown in FIGS. 5 to 7, the compressible element 600 is closely coupled to the connecting element 500, this case not being limiting. In these illustrations, the compressible element 600 is in the form of a sleeve defining an inner passage 602 directed along the longitudinal direction of the element 500 and configured so that the element 500 can be inserted into the passageway 602. The compressible element 600 is positioned so as to be in contact with a lower surface of the heel loop 200, on the one hand, and with an upper surface of the binding base 100, on the other hand. Here, the compressible element is also positioned in the area of the slot 204 of the heel loop 200 and of the housing 110 of the binding base 100, which are the areas of connection of the connecting element 500 with the binding base 100 and the heel loop 200. In the configuration shown, the sleeve forming the compressible element 600 surrounds the entire element 500, but this configuration is not limiting. For example, a U-shaped open sleeve may be employed. Thus, by wrapping the connecting element 500 even partially, the compressible element 600 can be protected from the weather.

In addition, the drawing figures show a compressible element 600 provided with beads 601 assuming the function of spring coils for performing an end of compression stroke of the compressible element 600 when the beads 601 are contiguous. Thus, the clearance in the approaching direction may be limited by the compressible element 600.

For example, the materials used for the heel loop 200 and the binding base 100 are polymers, such as polyamide or polycarbonate.

Furthermore, it is possible to configure the receiving device so as to define, for the rear portion of the heel loop, a rest position corresponding to a position in which no bias is applied by the user. This rest position is configured to allow a spacing movement of the heel loop 200 away from the binding base 100 along a defined first stroke, on the one hand, and an approaching movement of the heel loop 200 toward the binding base 100 along a predefined second stroke, on the other hand. In this case, the device is designed to obtain an asymmetrical stroke in relation to the direction of deformation of the heel loop, whether during relative spacing movement of a rear lateral portion of the heel loop and the binding base, or whether for their relative approaching movement.

In a particular embodiment, the first spacing stroke is less than the second approaching stroke. The first stroke is less and results, in the illustrated examples, from a play between the stop element 503 and the abutment surface 111, when the rear portion of the heel loop is in the rest position. Alternatively, the first spacing stroke may be zero. In this case, the design does not allow deformation tending to space a rear portion of the heel loop from the binding base.

In the example described, the rest position corresponds to the inclination of the heel loop in relation to the binding base, determined by the attachment points 107, 108, independently of the connecting elements 500. The overall connection system may enable relative mobility in both extension and compression around the rest position. For example, from the rest position and in the area of the median point of the heel loop 200 (middle of its dimension along the longitudinal direction "x"), the upward displacement may be limited to a maximum of 10 mm, and, in a particular embodiment, 5 mm. Similarly, from the resting position, the downward displacement of the central point of the length of the heel loop 200 may be limited to 20 mm, and, in a particular embodiment, 15 mm. These dimensions make it possible to obtain a good compromise between stability/strength and flexibility of movement.

In this case, the median point of the heel loop can move closer to the binding base than away therefrom.

These latitudes of movement enable an upward or downward vertical displacement of the rear portion of the heel loop, but also a rotational movement about a longitudinal axis of the binding base. These degrees of freedom provide the flexibility of movement sought by the rider/surfer.

It is the stop element 503 and the abutment surface 111, as well as the configuration of the compressible element 600 possibly present, which determine the values of the stroke.

In summary, according to the embodiments shown and described, the construction provides a heel loop 200 which is self-supported via at least one attachment point 107, 108. The rear portion 203 of the heel loop can be deformed substantially vertically by bending the lateral portions 201, 202 of the heel loop. The receiving device includes a stop mechanism comprising a connecting element and a stop in the binding base. This stop mechanism makes it possible to limit the bending of a lateral portion 201, 202 of the heel loop in one direction, that is, in the spacing direction of the rear portion from the binding base. This limitation preserves the structure of the receiving device because it is highly stressed in this direction, especially in the area of the attachment points. Thus, the connecting element is affixed to both the binding base and the heel loop, along a spacing direction, when the rear lateral portion of the heel loop and the binding base are spaced apart by a predetermined distance, in order to limit the upward clearance from the binding base.

Furthermore, the receiving device is designed to allow a greater displacement in the other direction, that is, in the approaching direction toward the rear portion of the binding base. In this direction, the structure is a little less stressed and therefore accepts greater deformation.

However, a stop mechanism can be provided. This can be achieved by the use of a compressible element 600 or by contact between the end 502 of the connecting element 500 with the upper surface 11 of the board.

The compressible element 600 may advantageously have an elastic behavior. This makes it possible to apply an elastic return to the heel loop to return it to an equilibrium rest position described above. The behavior of the receiving device is then dynamic and improves the boot holding sensations for the user. This helps the user in restoring a more stable equilibrium position. In other words, the compressible element 600 connecting the binding base 100 and the heel loop 200 is configured to exert a force tending to oppose the approaching movement between the binding base 100 and the heel loop 200 by elastic deformation.

The use of connecting elements 500 and/or compressible elements 600 distinct from the binding base/arch subassembly facilitates the customization of the behavior of the receiving device and its repair. Indeed, the flexibility, damping, or stroke of use of the device can be modified by easily changing a connecting element or a compressible element. For example, elements made of a material having different mechanical properties can be used. Similarly, the location of the stop elements 503 can be changed, thereby modifying the clearance stroke. Furthermore, if an element is damaged, it can easily be changed without having to replace the large parts of the receiving device. The maintenance is then more economical.

The invention can easily fit in a receiving device 1 without requiring additional parts. For example, the shaft 205 used to fix the connecting element 500 in the area of the heel loop 200 can also be used to articulate the rear support element 300 on the heel loop 200 and to fix the rear linkages 420. An example of this mutualized embodiment is particularly visible in the cross-sectional views of FIGS. 4 and 6, in which the shaft 205 extends, along the direction "y", through the entire width of the assembled device, in the area of the heel loop 200. The use of the same shaft 205 for fixing the connecting element 500, the rear linkages 420 and/or the rear support element 300, makes it possible to optimize the design by making the device more economical to produce.

In an alternative embodiment, the connecting element 500 is a cable, a strap, or a wire fixed to a rear lateral portion of the heel loop and to the binding base. In this case, the deformation of the rear part of the heel loop is indeed limited in the direction of its spacing in relation to the binding base, while allowing its approaching movement.

In the described embodiments, the receiving device comprises a connecting element on each side. In an alternative embodiment, only one side can be equipped with a connecting element. In this case, an asymmetric behavior with pivoting of the heel loop about a longitudinal axis in a single direction is preferred.

The invention provides flexibility to the surfer/rider by allowing him or her greater movement in the area of the boot, while ensuring sufficient support. This greater capability comprise vertical displacements of the heel of the boot and lateral movements of the heel of the boot. These degrees of freedom are related to a rotation about a longitudinal axis of the boot in the area of the sole. To obtain this flexibility in rotation or torsion, the receiving device should be designed so that the lateral portions of the heel loop surrounding the heel can have a relative vertical movement with respect to one another.

As described above, the relative vertical movement of the lateral portions of the heel loop is obtained either by sliding of a connecting element in relation to the binding base or the heel loop, or by deformation of the connecting element.

An alternative solution in relation to the embodiments described above, involves cutting the heel loop in the area of the rear portion 203. In other words, the right lateral portion of the heel loop is not connected to the left lateral portion of the heel loop in the area of the rear portion of the heel loop. Consequently, flexibility is provided to the device because the two lateral portions can have a relative movement with respect to one another. In an alternative, the two separate lateral portions are connected in the area of the rear portion of the heel loop by a flexible and/or compressible element. This makes it possible to always obtain this flexibility in torsion but providing greater strength and additional support. For these last two alternatives, the lateral portions of the heel loop are rigidly connected to the binding base, with an embedment-type of connection, or may also include a connection system providing some flexibility, for example by using a system similar to the first two embodiments described.

The invention is not limited to these particular embodiments. It is possible to combine the embodiments.

In addition, the invention is not limited to the embodiments described above, but extends to all embodiments covered by the appended claims.

Further, at least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. A device for receiving a foot or a boot on a gliding apparatus, the receiving device comprising:

a binding base extending along a longitudinal direction, from a rear end to a front end, and widthwise, from a first side to a second side;

a heel loop extending in the direction toward the rear end of the binding base, the heel loop having a rear lateral portion;

a connection system connecting the heel loop to the binding base, the connection system comprising:

at least one connecting element connecting the rear lateral portion of the heel loop to the binding base so as to limit or prevent relative spacing movement of the rear lateral portion of the heel loop from the binding base, while allowing relative approaching movement between the rear lateral portion of the heel loop and the binding base;

at least one point of attachment of the heel loop with the binding base, the heel loop being self-supported, independent of the at least one connecting element, and spaced away from the binding base rearward of the at least one attachment point during a rest position of the device;

the attachment of the heel loop to the binding base being structured and arranged such that, during use of the device, the heel loop does not rotate in relation to the binding base about a journaled pivot connection.

2. A receiving device according to claim 1, wherein:

the connecting element is continuously affixed to the binding base or the heel loop along a spacing or an approaching direction.

3. A receiving device according to claim 1, wherein:

the connecting element is affixed to the binding base and the heel loop along a spacing direction, when the rear lateral portion of the heel loop and the binding base are spaced apart by a predetermined distance.

4. A receiving device according to claim 1, wherein:

the connecting element is an elongated element comprising a first end designed to be affixed to the heel loop and a second end designed to be affixed to the binding base.

5. A receiving device according to claim 1, wherein:

the connecting element is a cable, a strap, or a wire.

6. A receiving device according to claim 1, wherein:

one end of the connecting element is designed to slidably move in relation to the binding base or the heel loop, during relative approaching movement between the rear lateral portion of the heel loop and the binding base.

7. A receiving device according to claim 6, wherein:

the end of the connecting element designed to slidably move in relation to the binding base or the heel loop comprises a stop element designed to cooperate with an abutment surface of the binding base or of the heel loop to block the relative spacing movement between the rear lateral portion of the heel loop and the binding base.

8. A receiving device according to claim 1, wherein:

the connecting element is rotatably mounted on a shaft fixed to the heel loop, the shaft being configured to further connect the heel loop to a linkage for holding the boot instep.

9. A receiving device according to claim 8, further comprising:

a rear support element designed to support a user's boot, said rear support element being hinged about the shaft or in relation to the binding base.

10. A receiving device according to claim 1, wherein:

the connecting element has a structure designed to bend or buckle following a compression force applied in a direction of the relative movement of the heel loop toward the binding base.

11. A receiving device according to claim 1, further comprising:

a compressible element connecting the binding base and the heel loop, and configured to exert a force tending to oppose approaching movement between the binding base and the heel loop by elastic deformation.

12. A receiving device according to claim 1, wherein:

the binding base and the heel loop form a single monolithic element.

13. A receiving device according to claim 1, wherein:

the at least one point of attachment between the heel loop and the binding base is in an area of a front portion of the binding base.

14. A receiving device according to claim 1, wherein:

the heel loop extends rearward in a plane inclined in relation to a plane of the binding base by an angle between 15° and 45°.

15. A receiving device according to claim 1, wherein:

at least in an area of the at least one point of attachment between the heel loop and the binding base, the heel loop is designed for deformation at least during the relative approaching movement between the rear lateral portion of the heel loop and the binding base.

16. A receiving device according to claim 1, wherein:

the rest position corresponds to an inclination of the heel loop in relation to the binding base, determined by the attachment points independently of the connecting elements.

17. A receiving device according to claim 1, wherein:

the connection system is structured and arranged to allow a greater range of movement of the heel loop in approaching the binding base than a range of movement away from the binding base.

18. A gliding apparatus comprising:

a gliding board; and at least one receiving device comprising:

a binding base extending along a longitudinal direction, from a rear end to a front end, and widthwise, from a first side to a second side;

a heel loop extending in the direction toward the rear end of the binding base, the heel loop having a rear lateral portion;

a connection system connecting the heel loop to the binding base, the connection system comprising:

at least one connecting element connecting the rear lateral portion of the heel loop to the binding base so as to limit or prevent relative spacing movement of the rear lateral portion of the heel loop from the binding base, while allowing relative approaching movement between the rear lateral portion of the heel loop and the binding base;

at least one point of attachment of the heel loop with the binding base, the heel loop being self-supported, independent of the at least one connecting element, and spaced away from the binding base rearward of the at least one attachment point during a rest position of the device;

the attachment of the heel loop to the binding base being structured and arranged such that, during use of the device, the heel loop does not rotate in relation to the binding base about a journaled pivot connection.

19. A receiving device according to claim 1, wherein:

the connecting element is configured to allow movement of the heel loop both toward and away the binding base by deformation of the heel loop; and the connecting element is further configured to allow an extent of movement of the heel loop toward the binding base different from an extent of movement of the heel loop away from the binding base.

20. A receiving device according to claim 1, wherein:

the connecting element is configured to allow movement of a median point of the heel loop both toward and away the binding base by deformation of the heel loop; and the connecting element is further configured to allow an extent of movement of the median point of the heel loop toward the binding base that is greater than an extent of movement of the median point of the heel loop away from the binding base.

21. A device for receiving a foot or a boot on a gliding apparatus, the receiving device comprising:

a binding base extending along a longitudinal direction, from a rear end to a front end, and widthwise, from a first side to a second side;

a heel loop extending in the direction toward the rear end of the binding base, the heel loop having a rear lateral portion;

a connection system connecting the heel loop to the binding base, the connection system comprising:

at least one connecting element connecting the rear lateral portion of the heel loop to the binding base so as to limit or prevent relative spacing movement of the rear lateral portion of the heel loop from the binding base, while allowing relative approaching movement between the rear lateral portion of the heel loop and the binding base;

at least one point of attachment of the heel loop with the binding base, the heel loop being self-supported, independent of the at least one connecting element, and spaced away from the binding base rearward of the at least one attachment point during a rest position of the device;

a rear support element designed to support a user's boot, said rear support element being in contact with the heel loop;

the rear support element being in contact with the heel loop by being hinged in relation to the heel loop; and the heel loop not being hinged to the binding base.

22. A device for receiving a foot or a boot on a gliding apparatus, the receiving device comprising:

a binding base extending along a longitudinal direction, from a rear end to a front end, and widthwise, from a first side to a second side;

a heel loop extending in the direction toward the rear end of the binding base, the heel loop having a rear lateral portion;

a connection system connecting the heel loop to the binding base, the connection system comprising:

at least one connecting element connecting the rear lateral portion of the heel loop to the binding base so as to limit or prevent relative spacing movement of the rear lateral portion of the heel loop from the binding base, while allowing relative approaching movement between the rear lateral portion of the heel loop and the binding base;

at least one point of attachment of the heel loop with the binding base, the heel loop being self-supported, independent of the at least one connecting element, and spaced away from the binding base rearward of the at least one attachment point during a rest position of the device;

a rear support element designed to support a user's boot, said rear support element being in contact with the heel loop; and the at least one point of attachment of the heel loop with the binding base being at a median zone of the binding base, the at least one attachment point being closer to the front end of the binding base than to the rear end of the binding base.

* * * * *